US005372551A

United States Patent [19]

McCarthy et al.

[11] Patent Number: 5,372,551

[45] Date of Patent: Dec. 13, 1994

[54] ENERGY CONSERVING PINSETTER WITH MINIMIZED PIN OVERFLOW

[75] Inventors: Corneilius M. McCarthy, Muskegon; Michael J. Katje, Spring Lake; Ted E. Brim, Grand Haven, all of Mich.

[73] Assignee: Brunswick Bowling & Billiards, Muskegon, Mich.

[21] Appl. No.: 80,290

[22] Filed: Jun. 21, 1993

[51] Int. Cl.[5] ..... A63D 5/09

[52] U.S. Cl. ..... 473/66; 473/73; 473/90

[58] Field of Search ..... 473/66, 67, 73, 89, 473/90, 94, 95, 96, 101

[56] References Cited

U.S. PATENT DOCUMENTS

| | | | |
|---|---|---|---|
| 2,983,510 | 5/1961 | Blewitt | 473/65 |
| 3,240,493 | 3/1966 | Cohen | 473/66 |
| 3,809,398 | 5/1974 | Schmid et al. . | |
| 3,966,206 | 6/1976 | Schmid . | |
| 4,151,993 | 5/1979 | Payne et al. | 473/66 |
| 4,813,673 | 3/1989 | Schmid . | |
| 5,152,525 | 10/1992 | Brim et al. . | |

*Primary Examiner*—Vincent Millin
*Assistant Examiner*—William M. Pierce
*Attorney, Agent, or Firm*—Wood, Phillips, VanSanten, Hoffman & Ertel

[57] ABSTRACT

Overflow of bowling pins in an automatic pinsetter (26) having a distributor (44) for distributing pins to a plurality of pin positions (90) may be substantially reduced by utilizing additional switches (150) in pin spotting cells (120) at each pin position to provide indications of whether a pin is loaded in the associated spotting cell (120), which information may be processed by a CPU (108) and used to deenergize a relay (230) controlling power to the distributor (44), a pit conveyer (34) and a pin elevator (38) to halt operation of such components when pin delivery is not required.

20 Claims, 5 Drawing Sheets

ENERGY CONSERVING PINSETTER WITH MINIMIZED PIN OVERFLOW

FIELD OF THE INVENTION

This invention relates to automatic pinsetters for bowling games, and more particularly, to improvements in automatic pinsetters of the type where a pin, after being transported past pinspotting stations, :may pass to one or more overflow points to be returned to the pit of the bowling lane with which the pinsetter is associated.

BACKGROUND OF THE INVENTION

Recent years have seen a shift by a major manufacturer of bowling equipment, the assignee of the instant application, to a wholly new design of automatic pinsetter, sometimes also referred to as a gamesetter. The shift in part is due to the new design having greater flexibility in setting differing pin combinations of less than all 10 pins employed in conventional bowling. The ability to set different combinations allows the establishment of a large variety of bowling games that may be scored on any of a variety of bases quite different from ordinary 10 pin bowling. It also facilitates the setting of various pin combinations for practice purposes.

The operating principals of pinsetters of this type are disclosed in a number of patents to August Schmid of Switzerland, including, but not limited to, U.S. Pat. Nos. 3, 809, 398 issued May 7, 1984; 3,810,617 issued May 14, 1974; 3,966,206 issued Jun. 29, 1976; and 4,813,673 issued Mar. 21, 1989; the details of all of which are herein incorporated by reference.

Commercially available pinsetters of this sort employ a pin distribution system generally as illustrated in the previously identified U.S. Pat. No. 4,813,673. In this system, two distinct transport systems are employed, one for delivering pins to 10 pin bowling positions 3, 6, 9 and 10. A second transport system delivers pins to positions corresponding to the 1 pin, 2 pin, 4 pin, 5 pin, 7 pin and 8 pin. That is to say, one transport system delivers pins to four pin positions while the other delivers pins to six pin positions.

The '673 patent, and commonly assigned Brim et al, U.S. Pat. No. 5,152,525 issued Oct. 6, 1992, feature the use of pin diverters which receive pins from a pin elevator that elevates fallen pins out of the pit for the bowling lane being served by the automatic pinsetter and diverts alternate pins to one or the other of the two transport systems. While this works well for the intended purpose, because one transport system series more pins than the other, and both are receiving the same number of pins over a given period of time, it is necessary that the transport system serving the fewer pin positions have an overflow whereby the excess pins that are not directed to pin stations or pin spotting cells associated with the various pin positions on the pinsetter can overflow and be returned to the pit. Furthermore, even with the transport system serving the greater number of pin positions, there occasionally arises a need to overflow pins back to the pit as, for example, when all pin stations are already loaded with pins. Typical commercially available versions of these types of pinsetters overflow 10–12 pins per frame.

The overflow is not particularly desirable. For one, because it necessarily means that pins are constantly being overflowed, there is increased wear on the pins because they are continually in motion except when spotted on the lane. There is also increased wear on the pinsetter because of the repetitive handling of pins that are being overflowed.

Furthermore, overflow is not desirable from the aesthetic standpoint. As is well known, the falling of pins in a bowling game generates considerable noise. The overflowing of pins similarly generates noise and thus increases the noise level in a bowling establishment. Reduction in such noise level would be highly desirable.

In addition to wear and noise, overflow is undesirable for other reasons as well. Those familiar with automatic pinsetters recognize that occasionally, so-called "pin jams" occur which require manual attention before automatic operation of the pinsetter may resume. Pin jams occur on a statistical basis in proportion to the number of pins handled. Consequently, if the number of pins handled by a pinsetter during a given scoring frame can be reduced, the rate of occurrence of pin jams will be commensurately reduced as will the need for manual intervention. Thus, reduction of pin overflow can also serve to increase reliability of an automatic pinsetter operation by reducing the occurrence of pin jams.

Thus, there is a real need for a new and improved automatic pinsetter having the advantages of flexibility in pin setting of automatic pinsetters made according to the Schmid patents and yet with minimized overflow to avoid the problems caused by wear, increased noise level and pin jams. The present invention is directed to meeting that need.

SUMMARY OF THE INVENTION

It is a principal object of the invention to provide a new and improved automatic pinsetter wherein the overflow of pins during pinsetter operation is substantially reduced. More specifically, it is an object of the invention to provide such a pinsetter with reduced overflow so as to reduce wear on bowling pins and on the pinsetter itself, reduce the noise generated by bowling pins as they are handled by the pinsetter, and reduce the incidence of pin jams that require manual intervention to be cleared.

An exemplary embodiment of the invention achieves the foregoing objects in a pinsetter construction which includes a frame and a plurality of pin receiving stations on the frame which are located in a predetermined pattern. A pin spotting cell is located at each of the stations and first and second pin transport systems, one serving some of the stations and the other serving the others of the stations is provided for receiving pins and transporting the pins to each of the stations. Each of the systems has an overflow to which pins may be delivered after all of the stations served by the associated system have received pins. A diverter is provided for selectively diverting pins to one or the other of the transport systems and sensors associated with each of the stations are provided for determining the presence or absence of a pin thereat. Means are responsive to the sensors for halting operation of the transport systems when pins are present in all of the stations served thereby to eliminate or minimize movement of pins to the overflow.

In a preferred embodiment of the invention, there are a predetermined number of the stations and one of the systems serves a greater number of the stations than the other of the systems. Means are provided for operating the diverter to divert pins to the systems in direct proportion to the number of stations served by each.

In a highly preferred embodiment, the diverter is a mechanical element mounted for movement between a first position for diverting pins to the one system serving the greater number of systems and a second position for diverting pins to the other system serving the lesser number of stations. The operating means comprises means for shifting the diverter between the two positions.

In a highly preferred embodiment, the shifting means comprises a spring for biasing the diverter towards the first position and a motor for moving the diverter against the spring to the second position. According to this facet of the invention, by using the spring to bias the diverter towards the first position which diverts pins to the greater number of stations, the number of energizations of the motor to shift the diverter is minimized to reduce wear.

In one embodiment of the invention, the motor is a solenoid.

A preferred embodiment of the invention contemplates the provision of a third transport system for transporting pins to the diverter and a pin sensor in proximity to the third system prior to the diverter for signaling the operating means that a pin is approaching the diverter.

In a highly preferred embodiment, there are 10 pin receiving stations and the greater number of stations is 6 with the lesser of stations being 4. The system operates to sequentially move the diverter in the following repeating sequence:

send pin to first system;
send pin to first system;
send pin to second system;
send pin to first system;
send pin to second system;
etc., etc., etc.

According to another facet of the invention, an automatic pinsetter is provided that includes a pinspotting deck movable toward and away from a pin deck for spotting pins thereon. The pinspotting deck has a plurality of pinspotting cells mounted to the deck at predetermined locations for movement between pin holding and pinspotting positions. A pin sensor is associated with each pinspotting cell for sensing the presence or absence of a standing pin on the pin deck at the associated location. A transport system is provided for transporting pins to each of the pin stations and to a subsequent overflow station. A diversion mechanism is disposed at each said location for sensing when the associated pinspotting cell is not occupied by a pin and for diverting a pin from the transport system to the associated pin cell. The invention specifically contemplates the improvement in such a pin setter wherein an additional pin sensor is disposed at each pin spotting cell for determining whether the associated cell is occupied by a pin, and means interconnecting the sensors for each pinspotting cell to provide a change of state signal in response to a given fallen or standing pin condition at the associated location.

In a preferred embodiment, each sensor and each additional sensor is a switch having normally opened, normally closed and common poles, and wherein the normally closed pole and normally opened pole of each of the sensors are respectively connected to the normally opened pole and normally closed pole of the associated additional sensor. The change of state signal is present across the common poles of the sensors at each such location.

In a highly preferred embodiment, the switches comprising the sensors are adapted to close through their normally open poles for standing pins and the switches is comprising the additional sensors are adapted to close through their normally open poles in response to the presence of a pin in the associated pinspotting cell. The foregoing facet of the invention allows the presence or absence of a pin loaded in a pinspotting cell to be determined independently of the presence or absence of a standing pin at the corresponding location, which in turn is employed to control of the transport system to assure that pins are loaded in the cell to prevent delays in the pin setting operation while at the same time allowing de, activation of the transporting system to avoid or minimize overflow.

According to still another facet of the invention, an automatic pinsetter with a deck movable toward and away from a bowling lane is provided. A plurality of pinspotting cells are mounted on the deck for movement therewith and for movement relative to the deck between a pin loading and a pinspotting position. A pin sensing pad is carried by each cell and faces the lane when the corresponding cell is in the loading position. A first switch is disposed on each cell and is operable by the pad when the corresponding pad contacts a standing pin on the lane. A pin sensor is also located in each cell and movable from one position to another when a pin is loaded in the corresponding cell. A second switch is disposed on each cell and is operable by the corresponding pin sensor when a pin is loaded in the corresponding cell.

According to still another facet of the invention, an automatic pinsetter for setting bowling pins at a plurality of predetermined pins positions includes a pin deck movable toward and away from a bowling lane defining a plurality of predetermined positions. A plurality of pinspotting cells are carried by the deck and movable therewith with each cell being at a corresponding one of the positions and movable relative to the deck between pin loading and pinspotting positions. Grippers are associated with each such cell for holding a pin therein when the cell moves from the pin loading to the pinspotting position. Means are associated with each cell for signaling whether a pin is loaded therein and distributor means are provided for distributing pins to each such cell. Means are provided for reading the signaling means to determine whether pins are loaded in at least some of the predetermined ones of the cells and means are responsive to the reading means for operating the distributor means to load pins in at least some predetermined ones of said cells if the reading means determines they are not loaded.

In one embodiment of the invention, the pinsetter undergoes a pinspotting or pin detecting cycle and the reading means is operative at or near the conclusion of the cycle.

In one embodiment of the invention, the cycle follows the first ball rolled in a bowling frame and the reading means read all of the cells.

In another embodiment of the invention, the distributor means distributes pins to the cells in a predetermined order with some of the cells being early in the order and others of the cells being last in the order. At least some predetermined ones of said cells are the other cells, which is to say, pins are distributed to those cells last in the order of distribution before they are required to minimize cycle time of the pinsetter.

Other objects and advantages will become apparent from the following specification taken in connection with the accompanying drawings.

DETAILED DESCRIPTION OF PREFERRED EMBODIMENTS

Figure 1:
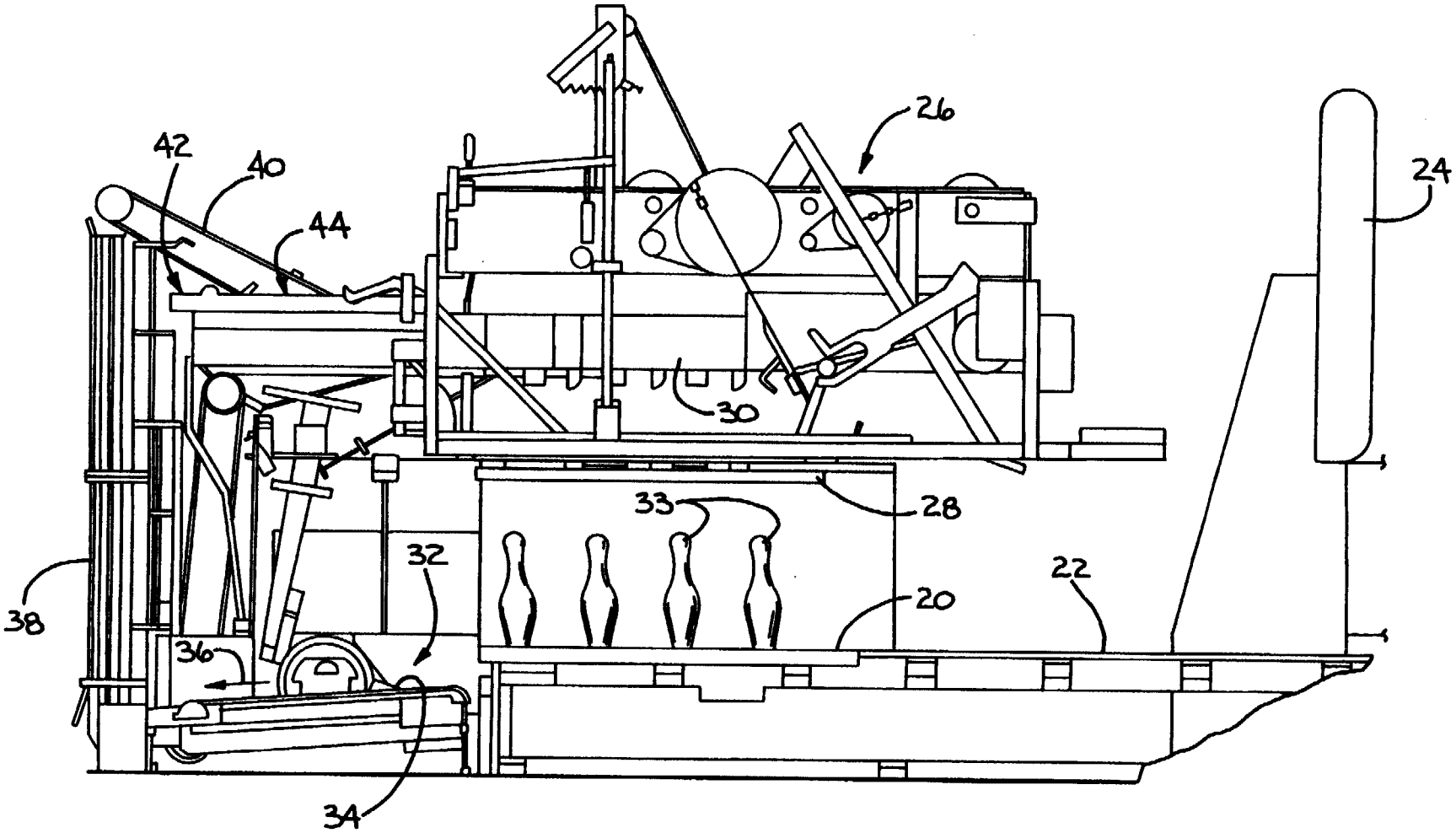
FIG. 1 is a side elevation of an automatic pinsetter made according to the invention.

An exemplary embodiment of a pinsetter made generally according to the previously-identified patents and with which the invention may be utilized is illustrated in FIG. 1 in overlying relation to the pin deck 20 of a conventional bowling lane 22. A masking unit 24 may be utilized to hide the pinsetter, generally designated 26, from the view of bowlers. The pinsetter 26 includes a conventional, vertically movable pinspotting deck 28 which receives pins in a normal fashion from corresponding pin stations, collectively given the reference numeral 30, and sets the pins at the predetermined locations employed, typically the well known 10 pin triangle. As is well known, there is a pin station for each of the pin stations and the pin positions are filled by pins moving on two spaced conveyor systems as will be described in greater detail hereinafter. In addition, as will be seen, the spotting deck 28 includes a plurality of pinspotting cells which move with the deck 28 and are also moveable thereon between pin loading and pinspotting positions. In the latter, pins 33 are spotted on the pin deck while in the former position, pins are loaded from the pin stations 30 into the spotting cells.

In the rear of the pin deck 20 is a so-called pit, generally designated 32, into which bowling pins 33 are periodically swept by action of the pinsetter or as a result of being impacted against by a bowling ball (not shown). Within the pit 32 is a pit conveyor 34 which is operative to move fallen pins in the direction of an arrow 36 toward the rear of the pit 32. Pins so delivered are received by a vertically oriented pin elevator 38 driven by a belt 40. The pin elevator 38 raises the pins and then discharges them into a pin orienting device, generally designated 42, which in turn delivers the pins, base end first, to a pin distributer system, generally designated 44. The latter, of course, delivers the pins to the pin stations 30. The pin orienting device 42 preferably is of the type disclosed in commonly assigned U.S. Pat. No. 5,152,525 issued Oct. 6, 1992 to Brim et al, the details of which are herein incorporated by reference.

Figure 2:
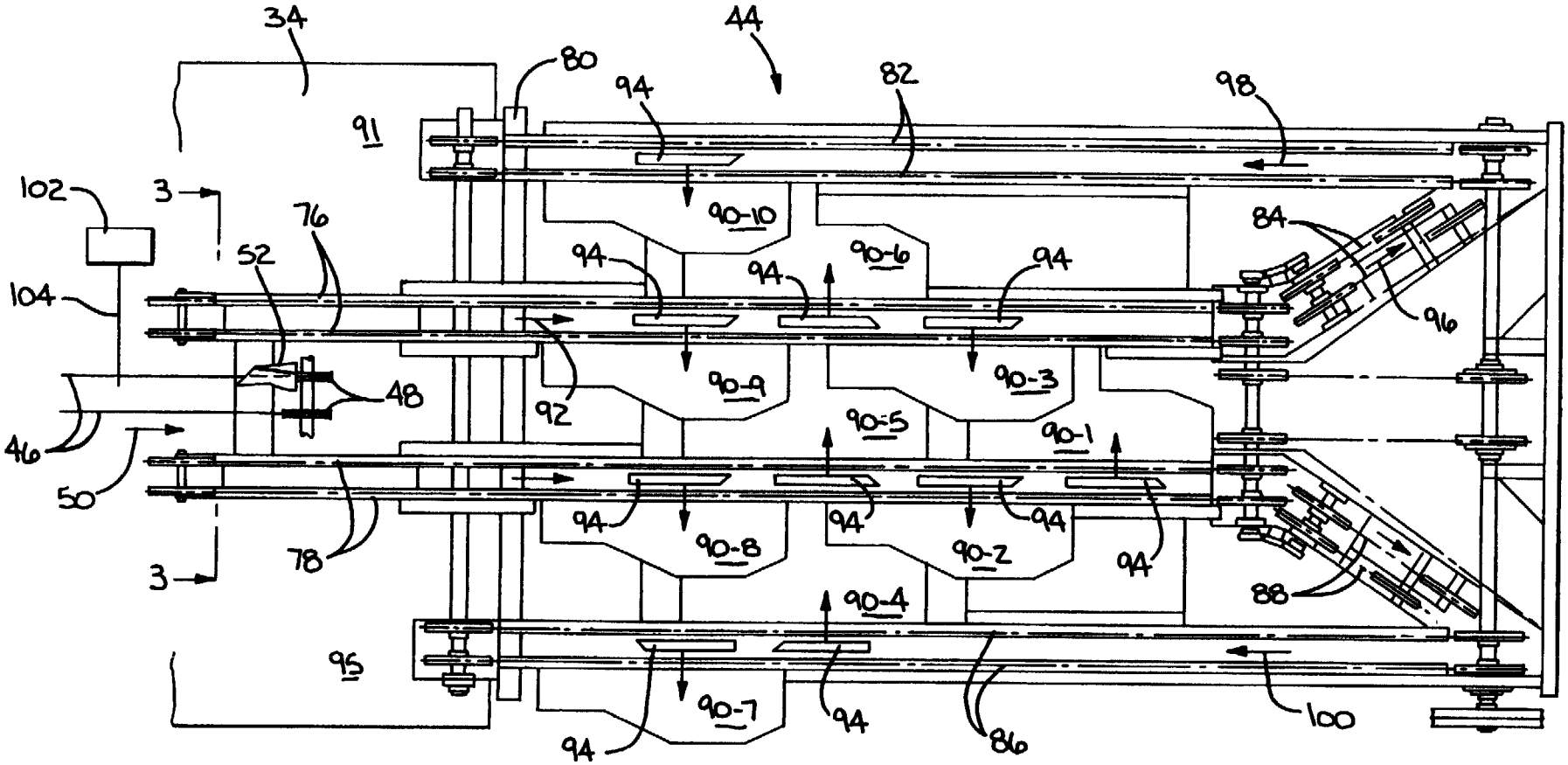
FIG. 2 is a plan view of a pin distribution system utilized in the invention.

Turning now to FIG. 2, the distributor system 44 will be described in greater detail. A pair of belts 46 reeved about sheaves 48 receive bowling pins, base end first, from the pin orienting device 44 and convey them in the direction of an arrow 50 towards a wedge-shaped diverter 52. The diverter 52 is mounted on the upper end of a shaft 54 which is rotatable about a horizontal pivot axis defined by a pivot pin 56 disposed between the belts 46 and below the upper runs thereof. The shaft 54 extends below the pivot pin 56 as well and mounts a pivot pin 58 which pivotally connects to a link 60 which in turn is pivotally connected by a pin 62 to the armature 64 of a solenoid 66.

The pin 58 is also connected to a tension spring 68 which in turn is connected to any suitable part 70 of the machine frame.

Extending away from the upper run of each of the belts 46 is a sloped ramp 72 and 74. The ramp 72 slopes towards the upper run of a pair of belts 76 which define a first transport system within the distributor 44. The ramp 74 slopes towards the upper runs of a pair of belts 78 which form part of a second transport system incorporated in the distributor 44.

A frame 80, via a suitable number of sheaves not numbered, mounts the belts 76 and 78 along with a pair of belts 82 and another pair of belts 84 forming part of the first transport system; and a pair of belts 86 and an additional pair of belts 88 which form part of the second transport system along with the belts 78.

As described more fully in the previously-identified Schmid U.S. Pat. No. 4,813,673, the frame 80 also defines a series of pin stations (shown collectively at 30 in FIG. 1) as follows: a first pin station served by the belts 76 is designated 90-9 because it serves the 9 pin position in conventional 10 pin bowling. A second station served by the belts 76 is designated 90-6 because it serves the 6 pin position. A third station designated 90-3 which corresponds to the 3 pin position and this position as well is served by the belts 76.

The pins are moved by the belts 76 in the direction of an arrow 92 and are deflected into the stations 90 by deflection fingers 94 if there is not already a pin in such station. If there is a pin in the station, by a mechanism such as disclosed in the previously-identified Schmid U.S. Pat. No. 3,809,398, the deflection finger 94 may move below the upper runs of the belts 76 and allow the pin to pass on to the next station.

When the stations 90-9, 90-6 and 90-3 are filled, pins will pass from the belt 76 to the belt 84 to move thereon in the direction of an arrow 96. From the belts 84, the pins will be passed to the belts 82 and move rearwardly in the machine in the direction of an arrow 98 towards a deflection finger 94 associated with a pin position 90-10 which corresponds to the location of the 10 pin in 10 pin bowling. If the pin is not deflected into the station 90-10, it will pass to the ends of the belt 80 which define an overflow station 91 whereat the pin overflows the distributor 44 to fall into the pit 34.

The belts 78, 88 and 86 forming the second transport system operate similarly except that the operation is in connection with 6 pin stations which are encountered in the following order: 90-8 corresponding to the 8 pin position; 90-5 corresponding to the 5 pin position: 90-2 corresponding to the 2 pin position; 90-1 corresponding to the head pin position and then on to the belt 88 and ultimately the belt 86 to be delivered next to the station 90-4 corresponding to the 4 pin position; and finally, 90-7 corresponding to the 7 pin position. Of course, at each of the pin stations associated with the belts 78 and 86, finger diverters 94 are provided.

Like the belt 82, the belts 86 terminate in an end 95 overlying the pit 34 which serves as an overflow station whereat pins that have not been diverted by the fingers 94 to any of the pin stations 90-8, 90-5, 90-2, 90-1, 90-4 or 90-7 are returned. To achieve this, pin movement on the belt 86 is in the direction of an arrow 100.

Figure 3:
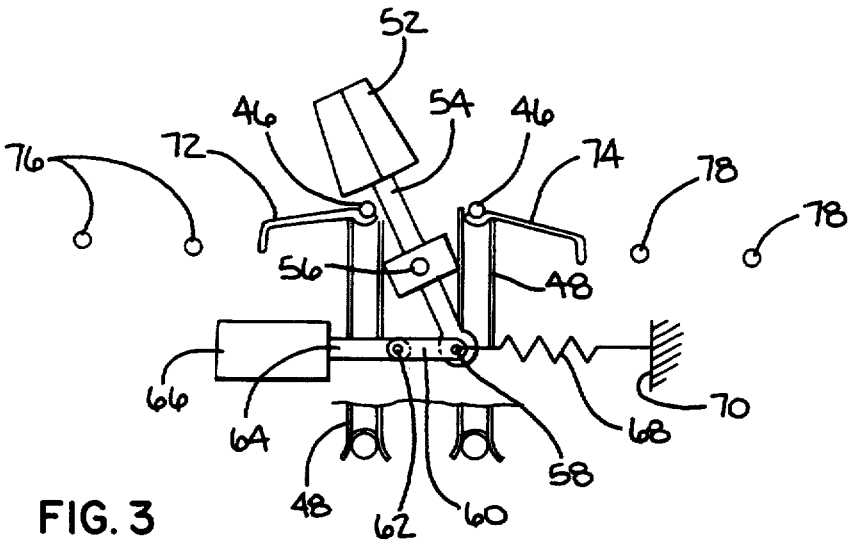
FIG. 3 is an enlarged, sectional view of a diverter employed in the invention and taken approximately along the line 3—3 in FIG. 2.

As shown in FIG. 3, the diverter 52 is biased generally in a counterclock-wise direction about the pivot pin 56 by the spring 68. When the diverter 52 is in the position illustrated, pins carried by the belts 46 will be diverted toward the belts 78. However, if the solenoid 66 is energized, the armature 64 is drawn inwardly and that will pivot the diverter 52 from the position shown in FIG. 3 to one more closely located to the belts 76, so that the diverter 52 will act to divert pins to the belts 76.

In this connection, it should be noted that the first transport system including the belts 76, 82 and 84 serves four pin stations whereas the second transport system including the belts 76, 86 and 88 serves 6 pin stations.

If pins were alternately deflected between the two transport systems, for every ten pins received on the belt 46, five would be deflected to the first transport system which would only require four pins while five pins would be deflected to the second transport systems which would require six. In this scenario, at least one pin would have to be overflowed to the pit 44 from the first transport system while there would be one too few pins to fill all of the pin stations associated with the second transit system. Accordingly, a wand switch 102 is associated with the belts 46 upstream of the diverter 52.

The wand 104 of the wand switch 102 is positioned to be struck by pins traveling on the belts 46 prior to the pin encountering the diverter 52. As shown schematically in FIG. 9, the resulting signal is passed on a line 106 to a central processing unit 108 provided in commercially available pinsetters of this type. Through appropriate software, the CPU 108 then operates to periodically energize the solenoid 66 by signals placed on a line 108. Specifically, for ten pin bowling the CPU operates according to the following program:

wait for a pin
send pin down 7 pin side (do not energize solenoid 66)
wait for one second
wait for a pin
send pin down 7 pin side (do not energize solenoid 66)
wait for one second
wait for a pin
send pin down 10 pin side (energize solenoid 66 for one second)
wait for one second
wait for a pin
send pin down 7 pin side (do not energize solenoid 66)
wait for one second
wait for a pin
send pin down 10 pin side (energize solenoid 66 for one second)
wait for one second As can be readily appreciated, the diverter 52 is thus operated to send pins to either the first or second transport system in direct proportion to the number of pin stations 90 served by each. It is also significant to note that the spring 66 normally biases the diverter 52 so as to direct pins to the transport system serving the most pins. This means that the solenoid 66 may be operated with less frequency than if the arrangement were reversed; and this in turn minimizes wear on the solenoid 66.

It should be understood that the foregoing program diverting pins in direct proportion to the number of pin stations 90 served applies to ten pin bowling and that other programs can be used for other games or other pin setups. For example, if the pinsetter 26 was being controlled by the CPU 108 to provide specific pin setups for practice bowling, and if a bowler was repetitively practicing the #5 pin–#7 pin split where both pin positions are served by the second transport system, the solenoid 66 for the diverter 52 need not be energized by the CPU 108 at all.

Similarly, if the #5 pin–#10 pin split was the object of the practice session, because the #5 pin position is filled by the second transport system while the #10 pin position is filled by the first transport system, the solenoid 66 will be energized to shift the diverter 52 for every second pin. Obviously, there are many other possible combinations as well.

It will accordingly be appreciated that through the use of the foregoing control of the position of the diverter 52, one cause of overflow in conventional machines due to the fact that the same number of pins are sent down each transport system even though the number of pin stations served by each differs resulting in an excess of pins on one system which must necessarily be overflowed is avoided. That is, according to the invention, each transport system receives pins in proportion to the number generally required to eliminate any excess that would have to be overflowed.

As alluded to previously, beneath each of the pin stations 90 and carried by the pin spotting deck 28, a pin spotting cell is located. One such pin spotting cell is shown in section in FIG. 4 and is generally designated 120. The pin spotting cell 120 is essentially, but not totally, conventional and is commonly found on commercially available pinsetters today. The pin spotting cell 120 includes a body 122 which in turn includes an upwardly opening cradle area 124 with an internal ramp surface 126. The belly of the pin is received in the cradle area 124 and the neck of the pin fits over the ramp surface 126 when the pin is released from the pin station.

A pin sensing arm 128 is located in the cradle area 124 and is mounted for pivotal movement about a pivot pin 130. A spring 132 connected to the arm 128 and to part of the pin spotting cell 120 in any suitable fashion biases the arm 128 counterclockwise about the pivot to the position illustrated in FIG. 4.

The arm 128 may pivot in a clockwise direction against the bias of the spring 132 in a slot 134 in the ramp 126 to a position whereat a nose 136 on the arm 128 is approximately at tile same height as the uppermost part of the ramp 126. A banana-shaped cam track 138 is formed in the arm 128 and receives a protuberance 140 on one arm 142 (FIG. 7) of a bell crank, generally designated 144.

Figure 7:
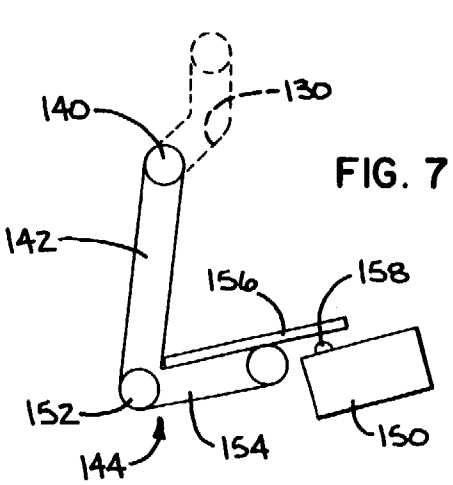
FIG. 7 is a view of another switch mechanism employed in the pinspotting cell.

Below the cradle area 124, the pin spotting cell 120 includes a generally vertically extending, depending web 146 which mounts a pair of microswitches 148 (FIGS. 4 and 6) and 150 (FIG. 7). The microswitch 150 is mounted on the remote side of the web 146 and thus does not appear in FIG. 4.

A pivot 152 pivotally mounts the bell crank 144 for rotation about a horizontal axis. The pivot 152 may, for example, extend through the web 146.

A remaining arm 154 of the bell crank 144 carries a leaf spring 156 on its upper surface. The leaf spring 156 extends past the end of the arm 154 into overlying relation with the actuator 158 of the switch 150. Consequently, as can be appreciated from a consideration of FIGS. 4 and 7, when a pin is located in the pin spotting cell 120, the neck of the same will lodge against the nose 136 of the lever 128 driving the same downwardly into the slot 134. The resulting downward movement of the cam track 138 will cause the bell crank 142 to pivot in a clockwise direction about the pivot 152 as viewed in FIG. 7 which in turn will bring the leaf spring 156 into engagement with the actuator 158 to thus change the condition of the switch 150. Thus, the switch 150 may be used to provide a signal indicative of the presence or absence of a pin loaded in the spotting cell 120.

A pair of ears 160 (only one of which is shown) depend from the underside of the spotting cell 120 adjacent one end thereof. The ears 160 support a pivot pin 162 to pivotally mount a pin sensing pad 164. An arm 166 extends from the pad 164 to the pivot 162. The pad 164 is operative to detect the presence of a standing pin 33 on the pin deck 20 (FIG. 1) when the pinspotting deck 28 is lowered for pin detection purposes and the spotting cell 120 is in the pin loading position illustrated in FIG. 4.

Figure 6:
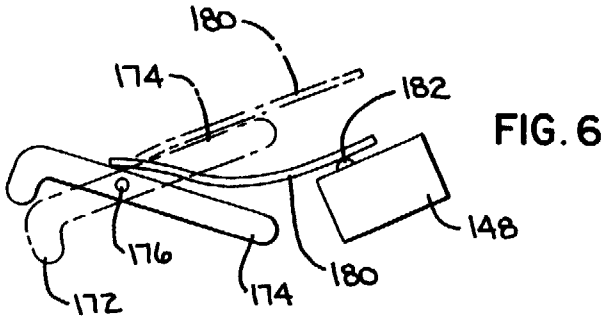
FIG. 6 is a view of one switch mechanism employed in the pinspotting cell.
Figure 4:
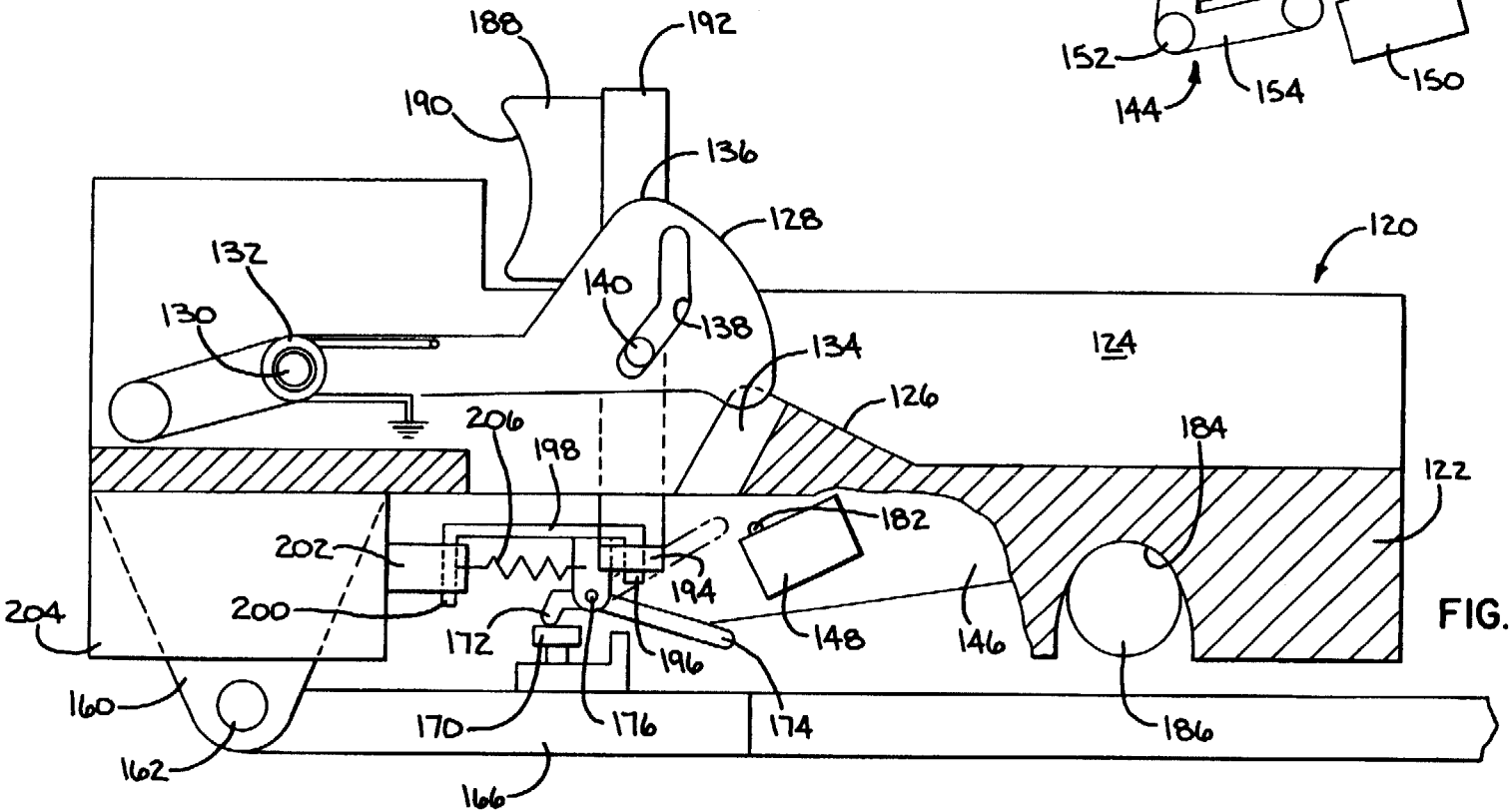
FIG. 4 is a vertical sectional view of a pinspotting cell employed in the invention.

More particularly, if a standing pin is encountered as the deck 28 is lowered, the pad 164 will tend to pivot in a counterclockwise direction about the pivot point 162. This, in turn, will cause an adjustable abutment in the form of a set screw 170 mounted to the arm 166 to abut the nose 172 of a lever 174 pivoted to the web 146 by a pivot pin 176 which may be coincident with the pivot 152. As seen in FIG. 6, the lever 174 also carries a spring finger 180 which overlies the actuator 182 for the switch 148. In the usual case, when the pad 164 has not encountered a standing pin, the lever 174 will assume the solid line position illustrated in FIG. 6 and the actuator 182 for the switch 148 will not be contacted by the spring FIG. 180. However, as the pin spotting deck 28 lowers and the pad 164 contacts a standing pin and pivots counterclockwise about the point 162 bringing the abutment 170 into contact with the nose 172, the lever 174 will shift to the dotted line position illustrated in FIG. 6 causing the spring finger to move against and depress the actuator 182 of the switch 148 to change the condition of the switch 148. Thus, the switch 148 is utilized to provide a signal corresponding to the presence of a standing pin at the location of the corresponding pin spotting cell 120. Each pin spotting cell also includes a recess 184 by which the pin spotting cell 120 may be pivotally mounted on a shaft 186 forming part of the pinspotting deck 128. As alluded to previously, the pinspotting cell 120 is shown in FIG. 4 to be in a pin loading position but the same may be rotated 90 degrees clockwise about the shaft 186 by conventional means to move the same to a pinspotting position. Thus, a pin received in the cradle area 124 may be delivered vertically to the pin deck 20.

Figure 5:
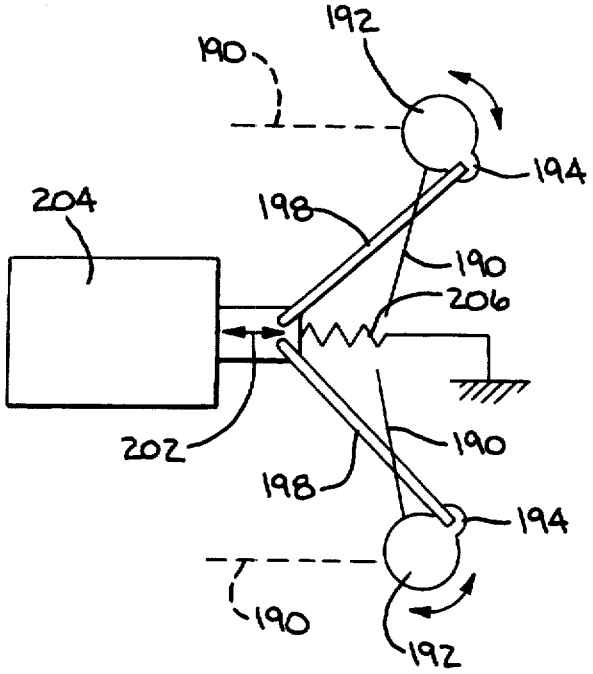
FIG. 5 is a somewhat schematic view of a gripper mechanism used in the pinspotting cell.

To restrain the pin during such movement, conventional grippers 188 (only one of which is shown) are located on each pin spotting cell 120 and are arranged to grip the corresponding pin about its neck to preclude the same from falling out of the pin spotting cell 120 as the same moves from the loading position to the spotting position. Each gripper 188 has a gripping surface 190 adapted to fit about the neck of the corresponding pin and is located on a rotatable shaft 192 that is journaled for rotation about a vertical axis (assuming the pin spotting cell 120 is in its loading position). As seen in FIGS. 4 and 5, each of the shafts 192 includes an eye 194 to which one end 196 of a link 198 is connected. The opposite end 200 of each link 198 is pivotally connected to the armature 202 of a solenoid 204 mounted to the underside of the pin spotting cell 120. A tension spring 206 extends between the armature 202 and the web 146 to normally bias the armature 202 to an extended position such that the grippers 190 will be in the solid line position schematically illustrated in FIG. 5 whereat they extend across the cradle space 124 to grip a pin about the neck. Energization of the solenoid 204 will withdraw the armature 202 into the body of the solenoid 204 thereby causing the grippers 190 to pivot to the dotted line position illustrated in FIG. 5 whereat a pin will be released for spotting purposes or whereat a pin may be loaded into the pin spotting cell 120. That is to say, when the solenoid 204 is energized, a pin may be loaded or released from the spotting cell 120 whereas when the solenoid is de-energized, the spring 206 will move the grippers 190 to the position illustrated in FIG. 5 which will retain a pin in the pin spotting cell and/or prevent loading of a pin into the pin spotting cell.

As alluded to previously, the spotting cell 120 is generally identical to that commercially available. As far as the present invention is concerned, the only essential differences reside in the use of two switches 148 and 150, one being operated by the pin sensing lever 128 and the other being operated by the pad 164. In the commercially available construction, only one such switch is employed and it is operated by either the pad 164 or the arm 128 via a lever which is essentially the composite of the bell crank 144 and the lever 174.

Figure 8:
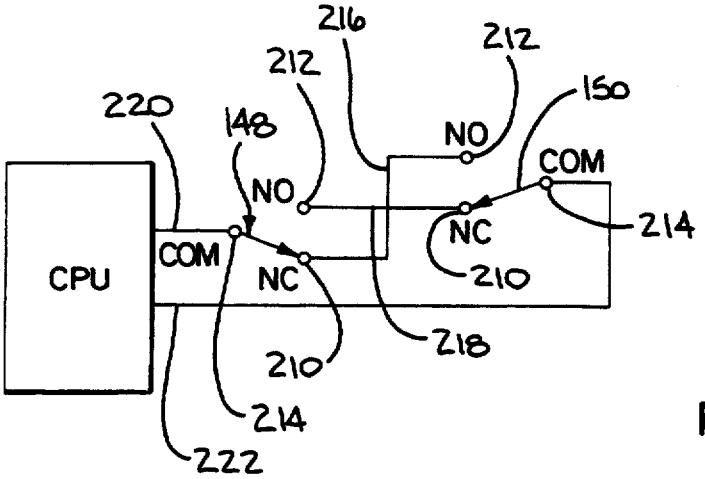
FIG. 8 is a wiring diagram showing the interconnection between the switches shown in FIGS. 6 and 7.

A unique electrical configuration of the switches 148 and 150 is illustrated in FIG. 8. Each of the switches 148 and 150 includes a normally closed contact 210, a normally open contact 212 and a common pole 214. A jumper 216 cross-connects the normally closed contact 210 of the switch 148 and the normally open contact 212 of the switch 150. Another jumper 218 cross-connects the normally closed contact 210 of the switch 150 and the normally open contact 212 of the switch 148. Leads 220 and 222 are connected to the common poles 214 of the switches 148 and 150 respectively. Change of state signals will be present across the leads 220 and 222 which are used for control purposes.

Operation of the circuit is as follows. Assume that there is no pin in the spotting cell 120. In this situation, the switch 150 will be closed through to its normally closed contact 210. If a standing pin is detected, a switch 148 will close through its normally open contact 2 12 and the circuit between the leads 220 and 222 will be closed, which is to say the switch combination will be on.

Conversely, if there is a pin in the spotting cell 120, the switch 150 will be closed through its normally open contact 212. At this point, the leads 220 and 222 will be connected through the switch combination and the latter will be "on" in this situation. If a standing pin is then encountered, the switch 148 will close through its normally open contact 212 thereby turning the switch combination "off."

Thus, the detection of standing pins and the determination of the presence of pins in a spotting cell is not made by looking at the switch combination to see of it is on or off. Rather, the switch combination is looked at periodically to see if its condition has changed from some initialized state. The time at which the switch combination is read for a change of state determines whether a changed state is indicative of a standing pin or a loaded pin. That is to say, because pin detection can only occur when the pin deck 28 is lowered to a pin detecting position, when the deck 28 is above a pin detecting position, the switch 148 will always be closed through its normally closed contact 210. Consequently, the loading of a pin into the pin spotting cell will cause the switch 150 to close through its normally opened contact 212, thus turning the switch combination "on" to indicate a loaded pin.

Those skilled in the art will readily recognize that pinsetters of the type of concern, namely, pinsetters bearing the model numbers GS10 and GS92 available from the assignee of the instant application, have four switches that are sequentially operated as the pinsetter cycles. These four switches are collectively designated 223 in FIG. 9 and are referred to in the trade as the A switch, the B switch, the C switch and the D switch. They are connected to the CPU through leads shown as a line 224 in FIG. 5. For a detailed discussion of the switches, reference may be had to the "Operation and Service Manual" for a GS-92 pinsetter available from the assignee of the instant application as part no. 47-902719-000 and specifically, chapter 4 thereof. For purposes of the present invention, it is sufficient to note that the operation of the A switch occurs at the home position which is to say the highest position of the pin spotting deck 28. The B switch is operated at the middle-height position of the table while the C switch is operated at the lowest position of the table which corresponds to the position at which pins are spotted. The D switch is operated at the middle position of the table.

The switches are operated by a cam which may turn either counterclockwise or clockwise with the pinspotting deck drive 226 as the pinsetter cycles. In a first ball cycle wherein standing pins are encountered, the cam 226 will first travel 360° counterclockwise to detect standing pins and elevate them, allowing a sweep to clear the deck of fallen pins. Motor direction for the pinsetter will then reverse causing the cam 226 to travel in a clockwise direction as the standing pins are respotted and the deck returns to its uppermost position.

Figure 9:
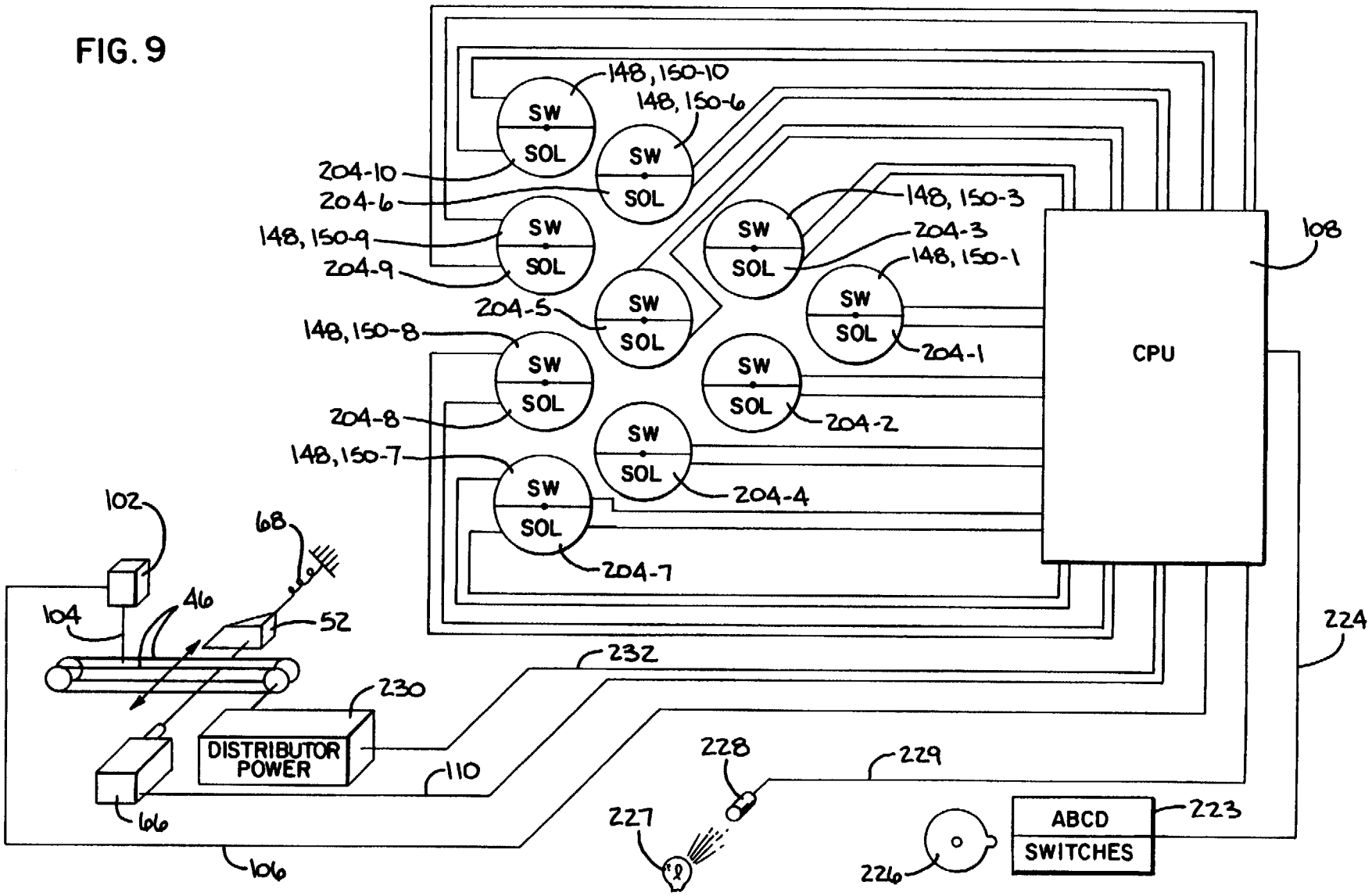
FIG. 9 is a partial schematic, partial block diagram of the controls for the pinsetter.

Initiation of pin setter operation occurs when a ball has been detected passing to the pit. As seen in FIG. 9, a light source 227 on one side of the lane normally illuminates a photocell 228 on the other. The photocell is connected by a line 229 to the CPU 108 and when shielded from the source 227 by a passing ball, signals the CPU 108 to start a pin setter cycle.

According to the present invention, a setting cycle for first ball is as follows:

TABLE 1

| First Ball Setting Cycle | |
|---|---|
| 1. t = 0.0 secs | Ball passes through photocell. Ball door locking solenoid actuates and door is locked for 2-3 seconds. Start distributor. |
| 2. t = 0.5 secs | Sweep release solenoid actuates and sweep board drops, switch "G" closes when sweep board is all the way down. Read and store the state of all 10 deck switch combinations. |
| 3. t = 3.0 secs | Setting table motor turns counterclockwise and setting table lowers as far as stroke limiter. |
| 4. t - 4.0 secs | Switch "B" operated by cam shaft. When switch "B" is operated by the motor turning counterclockwise, the following functions are released:<br>a. Player control pin indicator memory is unlocked to receive pin fall information.<br>b. Wait 240 msec. Read the current state of the pin switches.<br>c. If not all pins have fallen, the spotting tong solenoid starts operating immediately after the cam shaft passes switch "B" (contacts open). The spotting tongs close and hold the standing pins. |
| 5. t = 5.0 secs | Switch "C" operated. |
| 6. t = 6.0 secs | Switch "D" operated, spotting tong solenoid switches off and table moves upward. |
| 7. t = 7.0 secs | Switch "A" operated and setting table motor is off. |
| 8. t = 7.0 secs | Sweep motor turns on. Sweep cycles 360°. |
| 9. t = 9.0 secs | Setting table motor turns on and turns clockwise to lower table. |
| 10. t = 12.0 secs | Switch "D" operated (setting table motor turning clockwise and spotting tong solenoid is on. Spotting tongs begin to open. |
| 11. t = 13.0 secs | Switch "C" operated. Spotting tongs are open and pins are on pin deck. |
| 12. t = 13.5 secs | Switch "B" operated. Read pin switches and energize gripper solenoids at "off" switch locations to open the grips for loading. |
| 13. t = 15.0 secs | Switch "A" operated, setting table motor is off and pinsetter is in starting position. The open pin holder grips engage the pin release levers of the distributor pin stations and the pins fall into the pin holders spotting cells. As switches close, gripper solenoids deenergize and grippers close. |
| 14. t = 15.0 secs | When all switch combina- |

TABLE 1-continued

| First Ball Setting Cycle | |
|---|---|
| | tions are "on," turn off distributor. |

In addition to the foregoing pinsetter cycle, the pinsetter control which includes the CPU 108 (FIG. 9) operates to determine the presence or absence of standing pins at the various pin positions as follows. Specifically, after the current state of the pin switches is read, 4.(*b*) above, the CPU 108 causes a comparison of the state of the pin switches as read at step 2. of the cycle with the state of the switches as read at step 4(*b*). If any state has changed, that is indicative of a standing pin and that information is then processed within the CPU 108 in a conventional fashion. Logically, an exclusive OR comparison is made according to the following table.

TABLE 2

| Stored State | Current State | Standing Pin? |
|---|---|---|
| Off | Off | No |
| Off | On | Yes |
| On | Off | Yes |
| On | On | No |

Thus, the CPU interrogates sources of the stored state of the switches along with the state of the switches as determined at pin detection time and provides a standing pin indication as appropriate.

As alluded to previously, the state of a switch combination will change when a pin is loaded into a pin cell 120. This circumstance is looked at at some time other than the pin detecting part of the cycle, and towards the end thereof. The purpose will be apparent from the following.

It will be recalled from the discussion of FIG. 1 that the installation includes a pit conveyer 34, a pin elevator 38 and the distributor 44. Each of these is motor driven and is for the purpose of moving fallen pins from the pit 32 to the pin stations 30.

According to the present invention, a distributor power relay 230 is connected by a line 232 to the CPU 108 and is operative to energize electric motors for the distributor 44, the pin elevator 38 and the pit conveyer 34 only when instructed to do so by the CPU 108. Preferably, the motors used in driving these components are three phase motors which are less stressed than single phase motors when subject to a repetitively stopping and starting duty cycle.

According to the invention, these components are energized only when there is a need to deliver pins to the pin stations 30 and at no other time or times. Consequently, by shutting clown these components, much undesirable overflow of pin can be avoided.

Thus, according to the invention, at step 12. of the first ball cycle, the pin switch combinations are read at each pin position and the solenoids 204 at those pin positions where the switch combination is "off" are energized to allow loading of a pin into the associated pin spotting cell 120. Earlier, at the time a ball is detected by the photocell 228, the CPU 108 will have energized the power relay 230 to provide electrical power to the motors for the pit conveyer 34, the pin elevator 38 and the distributor 44 so that pins will be moved to the various pin stations by the two transport systems described previously. At some subsequent time, which may be indeterminate depending upon the number of pin spotting cells requiring loading, the switch combinations at all ten locations will all turn "on" indicating that all of the spotting cells 120 are loaded with pins. At this time, the CPU, upon receiving the on signal from the switches 148, 150, will cause the relay 230 to de-energize the motors for the pit conveyer 34, the pin elevator 38 and the distributor 44.

This assures that all pin spotting cells are loaded so as to deliver a new set of all ten pins upon the next cycle. At the same time, it minimizes overflow because pin movement is halted as soon as all cells are loaded. It has been found that a power savings will result because the motors for the pit conveyer 34, the pin elevator and the distributor 44 are turned off much of the time.

A second ball cycle according to the invention, which includes pin detection for scoring purposes, is set forth below.

TABLE 3

| | |
|---|---|
| 1. t = 0.0 secs | Ball breaks photocell beam and distributor restarts, if presently off. |
| 2. t = 0.5 secs | The sweep is lowered into the guard position and the ball door is locked for 3 seconds. |
| 3. t = 3.0 secs | The table motor runs counterclockwise to allow the table to lower. The cam on the table shaft will leave switch "A". |
| 4. t = 4.0 secs | The table rack will lower and close the switch denoting a full detection stroke. |
| 5. t = 4.0 secs | The table will make a short stroke as it stops on the stroke limiter plate. |
| 6. t = 4.0 secs | As the cam passes the "B switch" the game setter will read all ten pin detection switch combinations. At this point the game setter updates the pin fall display and sends the pin fall activity to the scoring system. |
| 7. t = 5.0 secs | The cam passes switch "C" with no action. |
| 8. t = 6. 0 secs | The cam passes the "D switch". |
| 9. t = 7. 0 secs | The table returns to its raised position. The table motor switch will turn off when the "A" switch is closed. |
| 10. t = 7.0 secs | The sweep motor is turned on and pulls the sweep back and forward to clear the dead wood. When the sweep is fully forward once again, the "SM" switch is closed and the sweep motor is turned "off". |
| 11. t = 9. 0 secs | The table motor runs clockwise and the cam leaves the "A" switch and travels to switch "D". |
| 12. t = 9.0 secs | As the table starts lowering, the stroke limiter solenoid is energized and pulls the stroke limiter plate back. This allows a table to go down for a long stroke to the pinsetting height and releases the swing shafts on the table. This allows |

TABLE 3-continued

| | |
|---|---|
| | the spotting cells to go to the vertical pinsetting position. |
| 13. t = 13.0 secs | The cam passes "D" and at "C" the pin solenoids are energized, the grippers opened and the pins deposited on the lane surface. At "B" the pin solenoids are deenergized and the grippers are closed. |
| 14. t = 14.5 secs | #7 and #10 pin gripper solenoids reenergized to allow preload of #7 and #10 pin spotting cells. Distributor continues to run to fill all pin stations. |
| 15. t = 15.0 secs | The pin fall display is reset. Switch "A" actuated. Setting table motor "off" and #7 and #10 pin spotting cells preloaded if pins available from #7 and #10 pin stations. Distributor continues to run and the pinsetter is ready for a new first ball cycle. |

Thus, it will be seen that according to the invention, at Step 14, the gripper solenoids 204 in the spotting cells 120 at the #7 and #10 pin positions are energized to open the grips at those spotting cells 90-7 and 90-10. At this time, the pin distributor relay 230 will have been on for several seconds as it is turned on at the time a ball is detected (see Table 3, Step 1). As a consequence, pins will be, or more likely, will have already been directed, to the #7 and #10 pin stations. Thus, when the table 28 returns to its home position, the open grippers at the #7 and #10 pin positions will trigger the corresponding pin stations 90-7 and 90-10 to release pins and the spotting cells 120 at the #7 and #10 positions will be preloaded.

The purpose of this function is to preload the #7 and #10 pin positions because they are the most remote from the input end of the distributor 44 and thus require the longest interval to be loaded. By preloading them in this manner, a subsequent pin setter cycle may be shortened to prevent any possible delay of the game as a result of not all pin spotting cells being loaded.

This "preloading" feature of the invention is also employed when cycling the pinsetter following a strike. According to the invention, a typical cycle for a strike that includes the preload feature is as follows:

TABLE 4

| Setting Cycle For Strike | |
|---|---|
| 1. t = 0.0 secs | Ball breaks photocell beam and ball door locking solenoid actuates. Ball door is locked for 2-3 seconds. Start pin distributor. |
| 2. t = 0.5 secs | Sweep solenoid actuates and sweep board drops. |
| 3. t = 3.0 secs | Setting table motor turns left and setting table lowers as far as stroke limiter. |
| 4. t = 4. 0 secs | Switch "B" operated and strike is determined. Spotting tongs do not move. |
| 5. t = 6.0 secs | Switch "C" operated. |
| 6. t = 6.0 secs | Switch "D" operated and pin gripper solenoids energize to open grippers for loading. |
| 7. t = 7.0 secs | Switch "A" operated and setting table motor is off. Pin gripper solenoids deenergize to close grippers after as pins move from pin station to corresponding spotting cell and close switch thereat. |
| 8. t = 7.0 secs | Sweep motor is on if switch "G" is closed and the ball has passed through the ball door. Sweep cycles 360°. |
| 9. t = 9.0 secs | Setting table motor is on and turning clockwise if all spotting cells contain pins. As soon as switch "A" is passed, the table solenoid (to raise the stroke limiter) and pin holder latch (for swaying of loaded pin holders) are actuated. |
| 10. t = 13.0 secs | Switch "C" operated. Gripper solenoids energized to set 10 pins. |
| 11. 6 = 13.5 secs | Switch "B" operated. Gripper solenoids deenergized to close grippers. |
| 12. t = 14.5 secs | #7 and #10 pin gripper solenoids reenergized to allow preload of #7 and #10 pin spotting cells. Distributor continues to run to fill all pin stations. |
| 13. t = 15.0 secs | Switch "A" actuated. Setting table motor off and #7 and #10 pin spotting cells preloaded if pins available. Distributor continues to run. |

From the foregoing, it will be seen that the invention offers a number of advantages. By appropriate programming of the diverter 52 (FIGS. 2, 3, 9), the number of pins sent or diverted to each transport system is directly proportional to the number of pin stations 90 served by that transport system. Thus, neither transport system will be receiving an excess of pins in the normal course of operation of the machine which would have to be overflowed, thus contributing to the undesirable qualities associated with overflow. Of course, if one or more pin stations 90 served by one transport system are already filled, it is possible for some overflow to occur. However, through the invention, overflow is considerably reduced.

The invention also provides a further means for reducing overflow and which additionally saves power. That is the provision of means for halting operation of the pit conveyer 34, the pin elevator 38 and the pin transport system 44 under the circumstances previously described. By operating these components only when pins are demanded, in contrast to continued operation as in the prior art, overflow is also considerably reduced.

At the same time, pinsetter cycling is not slowed down as a result of the pinsetter "waiting" for pins to fill all pin positions. That feature of the invention that delivers pins to all pin stations as part of the first ball cycle, or that feature of the invention that preloads the pin spotting cells at the #7 and/or #10 pin positions as part of a second bail or strike cycle literally anticipate the needs for pins such that waiting for a pin is reduced, and generally eliminated entirely. Indeed, it has been found that with these features, it may be possible to reduce somewhat the number of pins being cycled by each pinsetter.

Tests have shown that a conventional pinsetter without the features of the invention will typically overflow from about eight to somewhat over twelve pins per frame dependent upon a number of factors which include the number of pins in the pinsetter to be cycled which is typically twenty-one or twenty-two, the pace of bowling, the type of bowling (ten pins vs. other types of bowling games), the number of balls used, that is, open bowling vs. league bowling, the proficiency of the bowlers, and rate of pin feed to the pin elevator. When the anticipatory loading functions described above are combined with proportional diversion of pins to the two transport systems by the diverter 52, a per frame overflow reduces to about six and one-half pins.

If the additional feature of the invention, the halting of operation of the distributor is incorporated, the number of pins overflowed per frame is reduced to about three per frame. That is to say, a 70% reduction in overflow appears to be obtainable based on actual tests.

Of course, it is preferred to employ all four features with the invention for maximum benefit. However, it is possible to eliminate one or more of the features if one desires to avoid the complexity and cost associated with implementing the same. For example, the specific diverter 52 employed herein could be eliminated in favor of alternating diversion as is known from the prior art while retaining the features of preloading the #7 and #10 positions or loading all ten positions along with halting operation of the distributor to still obtain an approximately 50% reduction in overflow. Thus, the invention minimizes overflow to provide substantial avoidance of the wear, noise an pin jam problems that are associated therewith. In dition, a recognizable savings in power consumptic is obtained and other advantages will be readily parent to those knowledgeable in the field of autc atic pinsetters.

We claim:

1. A bowling pinsetter c nprising:

a frame;

a plurality of pin recei ig stations on said frame and located in a predete ained pattern;

a pin spotting cell at ch of said stations;

first and second pin transport systems, one serving some of said stations and the other serving the other of said stations, for receiving pins and tranporting the pins to each of said stations, each of said systems having an overflow to which pins may be delivered after all of the stations served by the associated system have received pins;

a diverter for selectively diverting pins to one or the other of said transport systems;

sensors associated with each of said stations for determining the presence or absence of a pin thereat; and means responsive to said sensors for halting operating of said transport system when pins are present at all of the stations served thereby, to eliminate or minimize movement of pins to said overflow;

there being a predetermined number of said stations, one of said systems serving a greater number of said stations than the other of said systems; and means for operating said diverter to diverter pins to said systems in direct proportion to the number of stations served by each.

2. The pinsetter of claim 1 wherein said diverter is a mechanical element mounted for movement between a first position for diverting pins to said one system serving a greater number of stations and a second position for diverting pins to said other system; and said operating means comprises means for shifting said diverter between said positions.

3. The pinsetter of claim 2 wherein said shifting means comprises a spring for biasing said diverter toward said first position and a motor for moving said diverter against said spring to said second position.

4. The pinsetter of claim 3 wherein said motor is a solenoid.

5. The pinsetter of claim 2 further including a third transport system for transporting pins to said diverter and a pin sensor in proximity to said third system prior to said diverter for signalling said operating means that a pin is approaching said diverter.

6. A pin loading apparatus comprising:

a frame;

a predetermined plurality of pin receiving stations on said frame and located in predetermined positions;

first and second transport systems for transporting pins to said stations, said first system transporting pins to a greater number of said stations and said second system transporting pins to a lesser number of said stations;

a third transport system for transporting pins toward said first and second transport system;

a diverter between said first and second systems and said third system for selectively diverting pins received from said third system to either said first system or said second system;

a sensor for sensing when a pin is being transported by said third system toward said diverter; and means responsive to said sensor for operating said diverter to divert pins to said first and second systems in proportion to the ratio of said greater number to said lesser number.

7. The pinsetter of claim 6 wherein said diverter is mounted for movement between a first position for diverting pins to said first system and a second position for diverting pins to said second system; and said responsive means includes a driver for moving said diverter between said positions.

8. The pinsetter of claim 7 wherein said driver includes a spring biasing said diverter toward said first position and a motor operative against said spring to move said diverter to said second position.

9. The pinsetter of claim 8 wherein there are ten said stations and said greater number is six and said lesser number is four and said responsive means repetitively operates said diverter in the following sequence:

send pin to first system,
send pin to first system,
send pin to second system,
send pin to first system,
send pin to second system.

10. The pinsetter of claim 6 further including additional sensors, one at each said station, for detecting the presence of a pin thereat; and means responsive to said additional sensors for shutting down said transport systems when there is a pin at each of said stations.

11. In an automatic pinsetter or the like including a spotting deck movable toward and away from a pin deck for spotting pins thereon and having a plurality of pin spotting cells mounted to the deck at predetermined locations for movement between pin holding and pin spotting positions, a pin sensor associated with each said pin spotting cell for sensing the presence or absence of a standing pin on the pin deck at the associated location; a transport system for transporting pins to each of said locations and to a subsequent overflow station; and a diversion mechanism at each said location for sensing when the associated pin spotting cell is not occupied by a pin and for diverting a pin from said transport system to the associated pin cell, the improvement comprising:

an additional pin sensor at each said pin spotting cell for determining whether the associated cell is occupied by a pin, and means interconnecting the sensor for each pin spotting cell to provide a change of state signal in response to a given fallen or standing pin condition at the associated location.

12. The pinsetter of claim 11 wherein each said sensor and each said additional sensor include switches having normally open, normally closed and common poles and wherein the normally closed pole and normally open pole of each said sensor are respectively connected to the normally open pole and normally closed pole of the associated additional sensor, and said change of state signal is present across the common poles of the sensors at each said location.

13. The pinsetter of claim 12 wherein said switches comprising said sensors are adapted to close through their normally open poles for standing pins and said switches comprising said additional sensors are adapted to close through their normally open poles in response to the presence of a pin in the associated spotting cell.

14. In an automatic pinsetter including a deck movable toward and away from a bowling lane, the combination of:

a plurality of pin spotting cells each mounted on said deck for movement therewith and for movement relative thereto between a pin loading position and a pin spotting position;

a pin sensing pad carried by each said cell and facing the lane when the corresponding cell is in said loading position;

a first switch on each said cell and operable by said pad when the corresponding pad contacts a standing pin on the lane;

a pin sensor in each said cell and movable from one position to another when a pin is loaded in the corresponding cell; and a second switch on each said cell and operable by the corresponding pin sensor when a pin is loaded in the corresponding cell.

15. The pinsetter of claim 14 wherein said first and second switches each have normally open, normally closed and common contacts and the first and second switches of each cell are connected normally open to normally closed and said common contacts of each cell are adapted to provide a change of state output signal whenever either switch of that cell is operated.

16. In an automatic pinsetter for setting bowling pins at a plurality of predetermined pin positions, the combination of:

a pin deck movable toward and away from a bowling lane defining said pin positions;

a plurality of pin spotting cells carried by said deck and movable therewith, each said cell being at a corresponding one of said positions and movable relative to the deck between pin loading and pin spotting positions;

grippers associated with each said cell for holding a pin therein when said cell moves from said pin loading to said pin spotting positions;

means associated with each cell for signalling whether a pin is loaded therein;

distributor means for distributing pins to each said cell;

means for reading said signalling means to determine whether pins are loaded in at least some predetermined ones of said cells; and means responsive to said reading means for operating said distributor means to load pins to said at least some predetermined ones of said cells if said reading means determines they are not loaded.

17. The pinsetter of claim 16 wherein said pinsetter undergoes a pin spotting or pin detecting cycle having a beginning and a conclusion and said reading means comprises means operative to read said signalling means at or near the conclusion of said cycle.

18. The pinsetter of claim 17 wherein said cycle follows the first ball rolled in a bowling frame and said reading means comprises means for reading said signalling means for all of said cells.

19. The pinsetter of claim 16 wherein said distributor means distributes pins to said cells in a predetermined order with some of said cells being early in said order and others of said cells being last in said order, and said at least some predetermined ones of said cells are said other cells.

20. An automatic pinsetter for use in a bowling game comprising:

a deck movable toward and away from a bowling lane for setting pins thereon;

a plurality of pin spotting cells, one for each of a plurality of pin positions, movably mounted on said deck for movement between pin spotting and pin loading position;

a pin distributor including first and second pin transport systems, said first transport system serving some of said cells and said second transport system serving the remainder of said cells, each said system having a pin overflow to which pins may be delivered after all of said cells served by the associated system have been loaded;

a pin input to said distributor and including a diverter for diverting incoming pins to either said first system or said second system;

means for operating said diverter to divert oncoming pins to each of said systems in proportion to the number of said cells served by each;

a first sensor for each cell for sensing a standing pin at the corresponding pin position;

a second sensor for each cell for sensing the presence of a pin loaded therein;

means for reading said second sensors to determine whether pins are loaded in at least predetermined ones of said cells;

means responsive to said distributor to load pins to said at least some predetermined ones of said cells if said reading means determines if they are not loaded; and means responsive to said reading means for halting operation of said distributor if said cells are loaded to minimize or prevent movement of pins to said overflow.

* * * * *